United States Patent [19]

Laauwe

[11] 4,230,240

[45] Oct. 28, 1980

[54] DISPENSING VALVE PARTICULARLY FOR VISCOUS PRODUCTS AND HAVING A DOME-SHAPED APPLICATOR

[76] Inventor: Robert H. Laauwe, 237 Green Ridge Rd., Franklin Lakes, N.J. 07417

[21] Appl. No.: 58,247

[22] Filed: Jul. 17, 1979

Related U.S. Application Data

[63] Continuation-in-part of Ser. No. 969,796, Dec. 15, 1978.

[51] Int. Cl.[3] ..... B05B 11/04

[52] U.S. Cl. ..... 222/212; 222/494; 401/183

[58] Field of Search ..... 222/494, 513, 212; 401/183, 206

[56] References Cited

FOREIGN PATENT DOCUMENTS 1441112 4/1966 France ..... 222/494

*Primary Examiner*—Stanley H. Tollberg

*Attorney, Agent, or Firm*—Kenyon & Kenyon

[57] ABSTRACT

A dispensing valve, particularly adapted for a squeeze bottle containing a viscous product, has a valve head in the form of a thin flat wafer of small diameter stationarily supported as freely as possible from obstructions, and above it an elastically deflectable diaphragm having a central opening with a periphery that seats on the periphery of the wafer. Internal pressure causes the diaphragm to move slightly from the wafer during a dispensing operation. The diaphragm is dome-shaped and extends upwardly to form an externally ball-like applicator surface.

7 Claims, 5 Drawing Figures

Fig. 1.
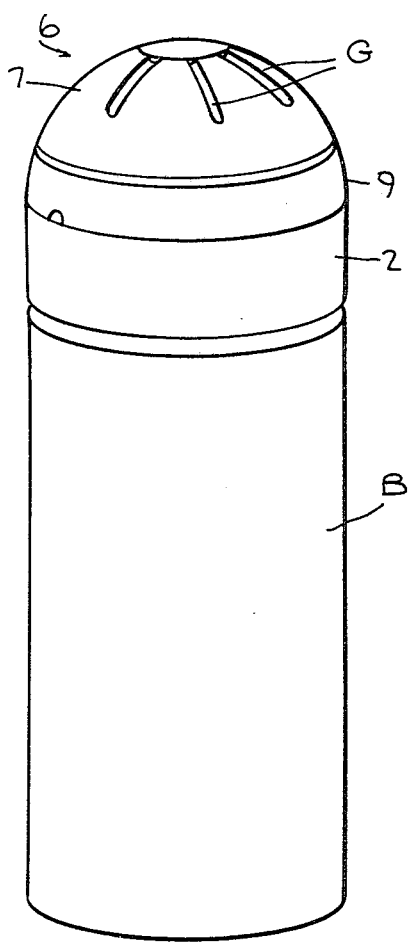
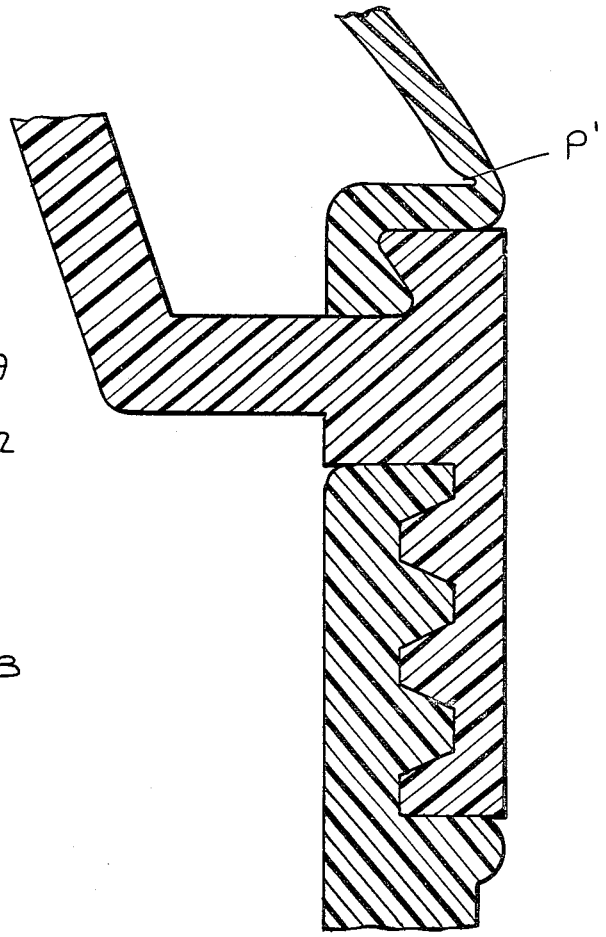
Fig. 4.
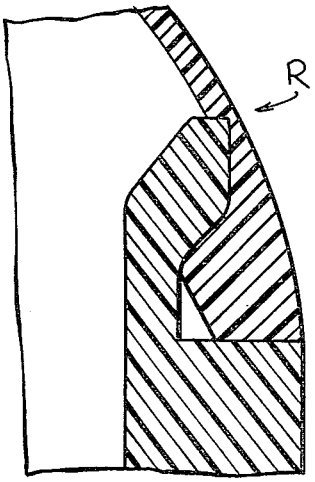
Fig. 5.
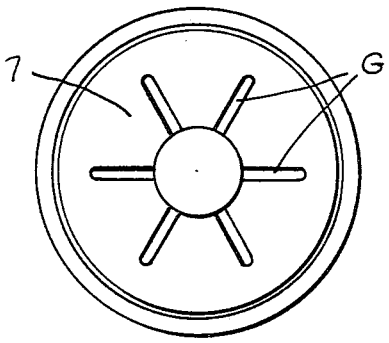
Fig. 2

S
P
9
9b
2
3
3a
6
10
1
5
4
8
11
7
11a
11b

DISPENSING VALVE PARTICULARLY FOR VISCOUS PRODUCTS AND HAVING A DOME-SHAPED APPLICATOR

This application is a continuation-in-part of application Ser. No. 969,796 filed Dec. 15, 1978.

BACKGROUND OF THE INVENTION

In that original application a unique valve for a viscous product contained by a squeeze bottle is disclosed as comprising, among other things, a base formed by a circular rim, a circular wafer and spokes connecting with and radiating from the wafer's bottom and extending radially to the rim in a plane below that bottom and positioning the wafer on and normal to the rim's axis. This wafer has a small diameter as compared to the rim's diameter so an annular open sapce is formed between the wafer and rim. Combined with this, there is a cap comprising an elastically flexible annular diaphragm positioned above the plane extending from the wafer's bottom and having a central opening with a periphery normally resting on the periphery of the wafer, and a depending flange connected to the rim of the base. The peripheries of the diaphragm's central opening and of the wafer have substantially mating conical surfaces.

This contrasts with the prior art in that no projection extends upwardly from the hub of the spokes, the latter being thin and mounting the wafer only by its bottom so that the wafer, in effect, floats stationarily in open space. When a viscous product is squeezed against the bottom of the diaphragm, it deflects upwardly so that the two peripheries separate. When the two peripheries return together, the product is free to flow from the mating conical surfaces so they close easily and provide a positive shut-off.

To promote the above positive shut-off, the wafer is made very thin with a flat top and bottom, the spokes having upstanding inner tips which connect with that bottom only adjacent to the wafer's periphery, in effect leaving the wafer's entire surface free from obstructions in any direction.

Before that new valve could be put into production and sale, and apparently because of the inability of prior art valve constructions to handle viscous products while being capable of manufacture, the industry concerned with the production and sale of packages containing viscous products, retrogressed and extensively readopted the old so-called roll-on form of dispensing device. This is the one comprising a rotating ball mounted in the top of the container usually made of rigid material as exemplified by rigid plastic or glass. The ball rolled on the viscous product by acting like the ball of a ball-point fountain pen. This construction does have the advantage that it provides the user with a rounded or ball-like applicator surface which is particularly popular in the case of roll-on deodorants for underarm use. It has the disadvantage that there is no real valve action involved, a cap being necessary to prevent excessive leakage in case this type of dispensing package is inverted for any length of time. In addition, the amount of material that can be carried from the surface of the ball rotating in the viscous material, onto the outside of the ball for application use, is uncontrollable. The material carried on the outside of the rotating ball is entirely dependent on the adhesive characteristics of the viscous product with respect to the ball's surface.

Another disadvantage is that the ball must be made to fit with relative precision in its socket which is attached to the product container, which makes the manufacture of this type of device undesirably expensive.

In the present instance, the object has been to provide a squeeze bottle valve which handles viscous products as effectively as does the valve of the above-identified application, but which will provide an external contour that is dome-shaped and to which the product is extruded by the valve so it spreads over the surface as in the roll-on type of device, but under the control of the user by controlled squeezing of the squeeze bottle.

SUMMARY OF THE INVENTION

According to the present invention, the above object is attained by making the elastically flexible annular diaphragm previously referred to, dome-shaped and so it extends upwardly from the rim of applicant's earlier valve, to form an externally ball-like applicator surface. With this improvement the diaphragm itself externally provides the contour of the ball-like roll-on, but with the advantage that the amount or thickness of viscous product carried by this surface is under the control of the user, the amount of the product on the surface depending upon the squeezing of the bottle with consequent automatic opening of the valve. When the bottle is not squeezed, the valve automatically closes. The dome-shaped diaphragm of the new construction can be made elastically flexible by having an annular hinging section adjacent to the diaphragm's depending flange of the earlier form of the valve.

With the diaphragm in its semispherical or dome-shaped or ball-like form, its top or central opening is closed by the previously described wafer when the bottom is not squeezed and the valve is not in operation, that is to say, closed. Preferably, the rounded or dome-shaped contour is continued through the depending flange, also previously described, so that the top of the valve is smoothly rounded throughout. This permits the production of an attractive product package by making the squeeze bottle cylindrical and as a smooth continuation of the valve's circular flange, the diaphragm's normally closed central opening forming a smoothly contoured construction free from distracting projections.

DESCRIPTION OF THE DRAWINGS

An example of this new valve construction is illustrated by the accompanying drawings in which:

FIG. 1 is a perspective view of a cylindrical squeeze bottle provided with the new valve and having the attractive appearance just described above;

FIG. 2 is a top view of FIG. 1;

FIG. 3 is a vertical section showing the valve construction of the previously described patent application but with the new dome-shaped diaphragm;

FIG. 5 is like FIG. 4 but shows a further possible modification.

DETAILED DESCRIPTION OF THE DRAWINGS

Figure 4:
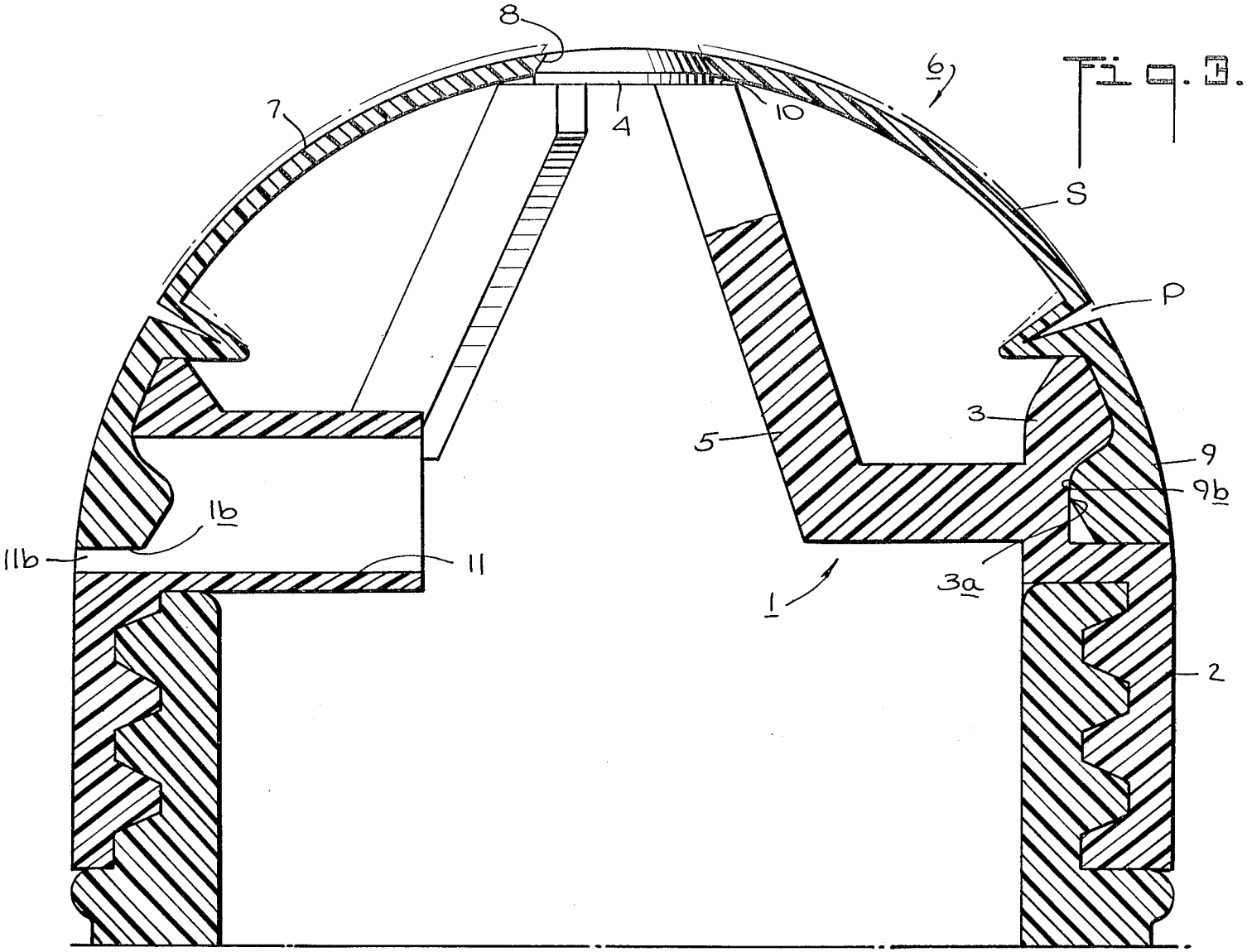
FIG. 4 shows a detail taken from FIG. 3 but in modified form.

The drawings show the base 1 in the form of an integral injection plastic molding and as having a skirt 2 which is internally threaded to fit the threads of a plastic squeeze bottle B having a standard 28 mm threaded mouth, thus providing a means for connecting the base to the bottle mouth, and therefore, fastening the previously described circular rim 3 to the mouth. The thin circular wafer 4 has its bottom integrally joined with the inner tips of the upwardly inclined spokes 5 which radiate from that bottom and extend radially to join with the rim 3 in a plane well below the wafer's bottom, positioning the wafer on and normal to the rim's axis. As illustrated, the wafer has a small diameter as compared to the rim's diameter and forms an annular space between the water and rim.

In this specific example, the rim 3 has an outside diameter of 0.950" and the wafer 4 has a maximum diameter of 0.230" and a thickness of 0.015", these values being given to exemplify the small dimensions involved by the actual valve and not being intended to be restrictive.

The cap 6, also an integral plastic injection molding, has the elastically flexible annular diaphragm 7 positioned above the plane of the bottom of the wafer and having the central opening 8, coaxial with respect to the wafer 4 and the rim 3, and having the periphery which normally rests on the periphery of the wafer. The integral diaphragm flange is shown at 9 as depending from the diaphragm's periphery and connected to the rim 3 of the base. The connection is made by interconnecting peripheral parts formed by the base and cap respectively and which permit the assembly of the cap by it being pushed down and snapped onto the rim of the base, but other interconnecting means might be used.

The peripheries of the wafer 4 and diaphragm's opening 8 is shown as having the substantially mating conical surfaces, in this instance the conical angle being 45° in both instances.

With the spokes having their upstanding inner tips connecting with the wafer's bottom only adjacent to the wafer's periphery, this bottom is otherwise free from obstructions in radial and downward directions. There is practically nothing to prevent the entirely free flow of a viscous product downwardly from the valve's wafer. There is no projection extending upwardly from the base to this wafer on which viscous material can collect and retard free flow downwardly from the wafer's periphery.

In this new form the flange 9 and diaphragm 7 extend upwardly from the rim 3 in dome-shaped form, extending upwardly from the rim so as to cooperatively form an externally-ball-like applicator surface S. This surface externally has grooves G radiating from the central opening 8 so as to distribute over the applicator surface S a product dispensed via the central opening when the squeeze bottle B is squeezed. The distribution of the product is under the control of the user squeezing the squeeze bottle.

The dome-shaped diaphragm, although made of elastically flexible material such as the normal plastic used for dispensing valves, may tend to be somewhat rigid because of its contour. Therefore, for even easier valve opening an annular hinging section is provided the diaphragm at a position adjacent to the diaphragm's depending flange 9. In FIG. 3 this hinging section is formed by the diaphragm having at least one inwardly extending pleat P integrally formed as part of the plastic diaphragm. In FIG. 4 the hinging section is formed by the diaphragm being made internally with an outwardly extending annular pleat P' formed by a substantial reduction in the diaphragm's wall thickness. In FIG. 5 the hinging action is obtained by a reduction in the wall thickness of the diaphragm as indicated at R in this figure. In all cases this hinging action results in the diaphragm extending from the annular hinging portion to the central opening 8, moving with a swinging action when the product to be dispensed is pressurized by squeezing of the bottle, resulting in the diaphragm's opening having a slight swinging or wiping action with respect to the valve seat formed by the wafer 4.

The diaphragm structurally tends to resist bending when a viscous product applies pressure to its inside or bottom, displacement of the diaphragm required for valve opening being obtained largely if not entirely via the annular hinging portion of the flange which is free from restraint to radial elastic flexure. In addition to this hinging action, in the FIG. 3 construction upward displacement of the diaphragm by pressure from below has a tendency to force the bottom portion of the flange 9 radially inwardly to force the interlock between the cap and the base into tighter engagement. As shown, the base has an annular groove **3*a* below its rim 3 while the cap's flange 9 has an annular inwardly extending rib 9*b*, the parts 3*a* and 3*b* snapping together when the cap is pushed onto the base during assembly of the valve. As just explained, this interlock is enhanced by what is, in effect, a rocking action of the flange 9 when its upper portion or top portion 9*a* is flexed outwardly due to upward motion of the diaphragm 7**.

At this point it is best to explain that in the foregoing and hereafter, reference is made to tops, bottoms, etc., as the valve is illustrated by the drawings. Actually, when in use, a squeeze bottle is normally inverted so the positions of the parts are reversed, but this fact does not interfere with the present description of the drawings as they show the valve.

Without placing some limit on the inward motion of the diaphragm 7, it might be possible for a user by hard finger pressure to force the diaphragm completely down below the wafer 4 so as to render the valve inoperative. Therefore, although it would otherwise be desirable to have the periphery of the wafer free from all downward obstructions, the spokes 5 which extend from the bottom of the rim 3 diagonally upwardly to the wafer 4, are at a level slightly below the bottom of the wafer, extended radially outwardly to form shelves 10 with which the inner periphery of the diaphragm 7 normally does not contact but which do serve to stop downward motion of the diaphargm when it is forced downwardly by outer pressure. This keeps the valve operative under all conditions of normally expected use.

In this illustrative example, both the diaphragm and wafer are designed with a wall thickness of 0.015. This illustrates the extreme thinness of the wafer 4 and the fact that these two major valve components require very little plastic, the major amount of plastic required being for the base 1 which must have, in any event, the rigidity required for fastening to the bottle mouth, and the two interlocking portions required for easy valve assembly.

The diameter of the wafer's bottom should preferably be not more than about one-third the diameter of the bottom of the diaphragm. In this illustrative example, the diameter of the wafer's bottom is 0.20" and the inside diameter of the diaphragm is 0.90". When in use on the squeeze bottle and the bottle is squeezed, the diaphragm has the maximum possible piston area presented to the pressurized viscous product to promote the hinging action. Finger pressure on the normal squeeze bottle need not be very great to operate this valve.

In this inventor's prior U.S. Pat. No. 4,057,177, it is explained that a pressure relief valve or check valve is necessary in a valve of the kind here involved, and the use of the so-called duck bill type of valve was proposed. In this instance, the duck bill is shown at all as extending transversely through the base 1 via the lower part of its rim 3.

This duck bill is transversely vertically oriented and extends inwardly from the base's rim 3 with the duck bill's mouth 11*a* terminating at a position outwardly offset from the wafer's periphery so as to leave the latter downwardly free from the duck bill. This, together with the duck bill's transverse vertical position, avoids entrapment of the dispensed product after the valve closes. The duck bill has a vent 11*b* extending transversely through and to the outside of the rim 3. This vent is formed by a radial slot 1*b* in the rim's top, the cap's flange 9 closing the outer end of the duck bill excepting for this slot located beneath the flange's bottom edge. The slot is of small dimensions so that the vent is of such small diameter as compared to the duck bill's diameter as to make the vent opening inconspicuous from the valve's outside.

As shown in particular by FIG. 1, the plastic squeeze bottle B has a cylindrical contour which merges smoothly and flushly with the skirt 2 and the diaphragm's flange 9, the diaphragm then smoothly curving upwardly to its center. This permits the production of an attractive package. The skirt 2 and the diaphragm's flange 9 and its surface 3 are all flush with each other.

What is claimed is:

1. A dispensing valve having a base comprising a circular rim, means for connecting said rim to a squeeze bottle's mouth, a circular wafer, and spokes connecting with and radiating from the wafer's bottom and extending radially to the rim in a plane below said bottom and positioning the wafer on and normal to the rim's axis, said wafer having a small diameter as compared to the rim's diameter and forming an annular space between the wafer and rim; and a cap comprising an elastically flexible annular diaphragm having a central portion positioned above said plane, said portion having a central opening with a periphery normally resting on the periphery of said wafer, and said diaphragm having a depending flange connected to said rim, said peripheries having substantially mating conical surfaces; wherein the improvement comprises said diaphragm being upwardly dome-shaped so it has an outer applicator surface that is ball-like in appearance.

2. The valve of claim 1 in which said surface has grooves radiating from said central opening so as to distribute over said applicator surface a product dispensed via the central opening.

3. The valve of claim 1 in which said diaphragm is made elastically flexible by an annular hinging section positioned adjacent to the diaphragm's said depending flange.

4. The valve of claim 3 in which said hinging section is formed by the diaphragm having at least one inwardly extending annular pleat.

5. The valve of claim 4 in which said hinging section is formed by a reduction in the wall thickness of said diaphragm.

6. The valve of claims 3, 4 or 5 in which the diaphragm's said depending flange externally forms a continuation of said ball-like applicator surface.

7. The valve of claim 6 in which said depending flange and the external surface of said circular rim are mutually flush.

* * * * *